US008861314B1

(12) United States Patent
Arabian et al.

(10) Patent No.: US 8,861,314 B1
(45) Date of Patent: Oct. 14, 2014

(54) SYSTEM, APPARATUS, AND METHOD FOR DISPLAYING THE TIME OF DAY

(71) Applicants: Christopher Arabian, Shelby Township, MI (US); Logan Arabian, Tallmadge, OH (US)

(72) Inventors: Christopher Arabian, Shelby Township, MI (US); Logan Arabian, Tallmadge, OH (US)

(73) Assignee: Luminosity Industries LLC

( * ) Notice: Subject to any disclaimer, the term of this patent is extended or adjusted under 35 U.S.C. 154(b) by 0 days.

(21) Appl. No.: 14/092,909

(22) Filed: Nov. 27, 2013

(51) Int. Cl.

| | |
|---|---|
| ***G04B 19/04*** | (2006.01) |
| ***G04C 19/00*** | (2006.01) |
| ***G04C 19/02*** | (2006.01) |
| ***G04C 17/00*** | (2006.01) |
| ***G04B 19/10*** | (2006.01) |
| ***G04G 11/00*** | (2006.01) |
| ***G04G 9/04*** | (2006.01) |

(52) U.S. Cl.
CPC ..... *G04B 19/10* (2013.01); *G04B 19/04* (2013.01); *G04G 11/00* (2013.01); *G04G 9/04* (2013.01); *G04C 17/00* (2013.01)
USPC ..... 368/80; 368/82; 368/239; 368/240; 368/223

(58) Field of Classification Search
CPC ..... G04B 19/00; G04B 19/04; G04G 11/00; G04G 9/04; G04C 17/00
USPC ..... 368/21, 80, 82, 239, 240, 223, 228, 232
See application file for complete search history.

(56) References Cited

U.S. PATENT DOCUMENTS

| | | | | |
|---|---|---|---|---|
| 3,757,511 | A * | 9/1973 | Burgess et al. | 368/83 |
| 5,359,578 | A * | 10/1994 | Truini | 368/76 |
| 5,410,520 | A * | 4/1995 | Stampfer | 368/240 |
| 5,694,376 | A * | 12/1997 | Sullivan | 368/82 |
| 6,198,698 | B1 * | 3/2001 | Graves | 368/82 |
| 6,556,513 | B2 * | 4/2003 | Wimberly | 368/82 |
| D626,876 | S * | 11/2010 | Jones | D10/124 |
| 2003/0103419 | A1 * | 6/2003 | Cheng | 368/240 |
| 2004/0022136 | A1 * | 2/2004 | Dagan | 368/223 |
| 2006/0092770 | A1 * | 5/2006 | Demas | 368/223 |

* cited by examiner

*Primary Examiner* — Vit W Miska

(57) ABSTRACT

A system, apparatus, and method for displaying the time of day. Reference points, including fixed reference points and movable reference points, can be used to display time information in a way that makes it easier for a vision impaired individual to read the display.

20 Claims, 11 Drawing Sheets

SYSTEM, APPARATUS, AND METHOD FOR DISPLAYING THE TIME OF DAY

BACKGROUND OF THE INVENTION

The invention relates generally to clocks. More specifically, the invention is a system, apparatus and method for displaying the time of day (collectively the "system").

Many historians believe that mankind's use of clocks can be traced back to Egyptian sundials going back as far as four thousand years ago. Since those first steps by human beings to track the time of day, people have become increasingly dependent on the ability to accurately tell time. Time is a dimension in which events can be ordered from the past through the present, and into the future. Time is one of the seven fundamental physical quantities in the International System of Units. The ability to accurately determine the time of day (i.e. to tell time) has important implications in the daily lives of most human beings.

Most mechanisms that convey information relating to the time of day rely exclusively or at least primarily on visual indicia (i.e. the sense of sight) to convey the time of day. Most clocks are read, not heard, touched, tasted or smelled. Acoustic and tactile indicia sometimes serve as limited special case supplemental sources of time information. Sounds, such as the chimes of a grandfather clock or the activation of an alarm, are the most common examples of secondary indicators, but such indicators are limited to a specific subset of times, such as the on the hour or a pre-set alarm time. With the increasing popularity of smart phones and other forms of remote computing, the sense of touch is sometimes utilized in providing tactile (i.e. vibration) alarms that relate to time of day. The senses of taste and smell are not used for the purposes of conveying time of day information.

Given the heavy reliance on the sense of sight, poor vision can substantially impede the ability of a person to accurately tell the time in a convenient manner. An estimated 75% of Americans rely on some type of vision correction devices such as glasses or contact lenses. During the course of the day, glasses or contact lenses can substantially remedy deficiencies in eyesight.

Unfortunately, there are certain contexts where vision correction devices such as glasses or contact lenses are not convenient for many users. One such prominent example is during the period of time from when someone is about to go sleep through the time they get up from bed. Conventional glasses can be easily damaged or misplaced as a result of normal motions of a human body while he or she is unconscious sleeping. Many types of contact lenses cannot be safely worn while asleep. While there are some specialized devices that can be worn for the purposes of vision correction during sleeping hours, such devices are relatively expensive for such highly specialized usage and are often undesirable for other reasons.

When a person suffering for significant vision wakes up in the middle of the night, the otherwise simple task of determining the time can be quite difficult. Poor vision couple with the grogginess of having just woken up leaves many people fumbling for their glasses, a light switch, or some other effort just to determine the current time of night. The negative impact of such struggling often impacts other people in the household.

The problem of night time/early morning clock reading is not a trivial one. The number one aspect that corrective surgery patients note after a successful procedure is the ability to read a bedside clock in the evening or in the morning. Unfortunately, not all vision impaired individuals are good candidates for corrective.

For many vision impaired individuals, increased font size is not a useful solution, even within three feet. At greater distances, increased font size is even less useful. Increased brightness is also of limited assistance, particularly for a person of elevated correction greater than a magnitude of +3 or −3.

SUMMARY OF THE INVENTION

The invention relates generally to clocks. More specifically, the invention is a system, apparatus and method for displaying the time of day (collectively the "system").

The system can utilize some or all of the following elements to display time of day information in a manner that is different from conventional analog or digital clocks: (a) a face boundary; (b) a pivot point; (c) a variety of reference points including a fixed reference point and a movable reference point; and (d) a hand.

The system can be more fully understood upon reading the accompanying drawings that are discussed briefly below.

BRIEF DESCRIPTION OF THE DRAWINGS

The following drawings illustrate different examples and embodiments of the apparatus.

The system can be more fully understood upon reading the following detailed description.

DETAILED DESCRIPTION

The invention relates generally to clocks. More specifically, the invention is a system, apparatus and method for displaying the time of day (collectively the "system").

I. Overview

For individuals with sufficiently poor vision, attempts to make numerical values on the clock easier to read through increased resolution, size, or brightness is not a viable solution. The system displays time information in a fundamentally different way than the display of a conventional analog clock or a conventional digital clock.

II. Introduction of Elements

Figure 1A:
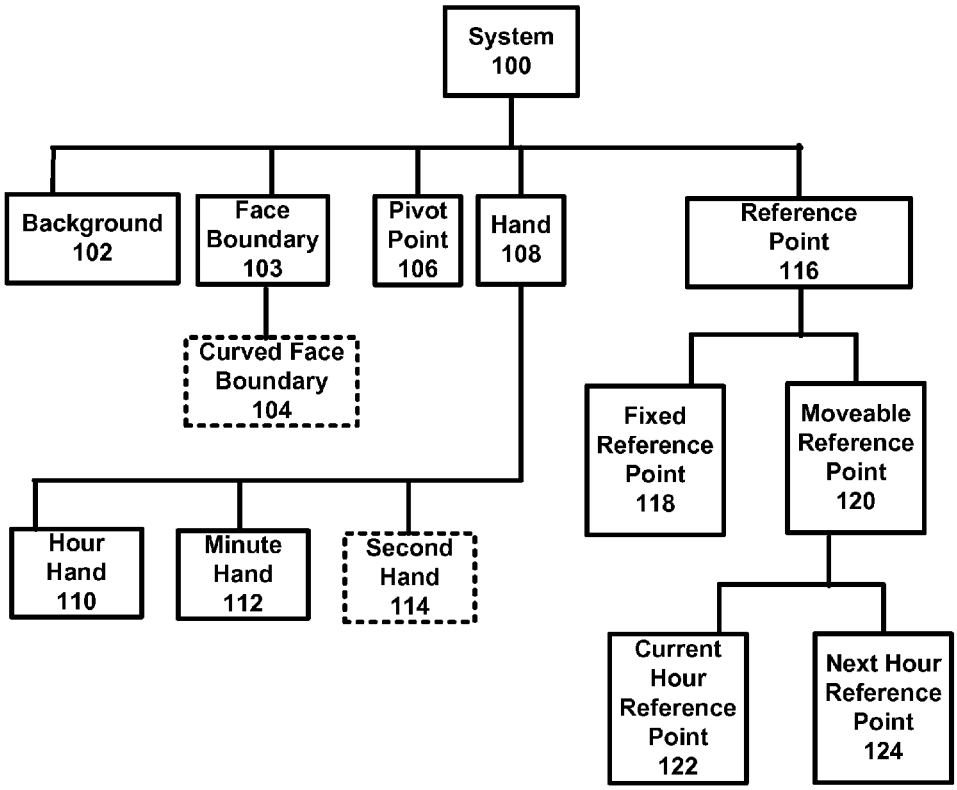
FIG. 1*a* is a block diagram illustrating an example of different components that can be included in the system.

FIG. 1*a* is a block diagram illustrating an example of different components that can be included in a system, apparatus, and method (collectively a "system" 100) for the display of time of day information. No specific combination of elements is required. For example, in many embodiments, there will be multiple hands and multiple types of reference points, but in some embodiments a user may desire to have less detailed information so that the display is as simple as possible.

A. System

The system 100 can also be referred to as a "clock apparatus" 100 or simply the "apparatus" 100 or "clock" 100. As illustrated in FIG. 1*f*, the system 100 can be implemented in the form of a mechanical clock 130, an electronic clock 132, an electro-mechanical clock 131, or as a computer program/software application 134 running on a computer (such as a general purpose computer or a more specialized hardware configuration) that is connected to a displayed on a screen or similar surface such as monitor, television set, or display screen for a smart phone or tablet computer. It is anticipated that many users will want to experience the system 100 as implemented in a software application 134 because such embodiments provide for substantial convenience and the capability for user customizations.

B. Background

Returning to FIG. 1*a*, a background 102 is a screen or surface behind the other elements of the system 100. The background 102 can also be referred to as the "display background" or "display surface". In a preferred embodiment, the background is solid black but a wide variety of different colors and/or graphically pattern configurations can be used.

C. Face Boundary

A face boundary 103 is a geometric shape comprising a line segment or a collection of line segments. The face boundary 103 can be unbroken or broken, such as a configuration of dotted or dashed segments. A point at the center of the face boundary 103 will often serve as a pivot point 106 for one or more hands 108 of the system 100. Face boundaries 103 can be embodied in a wide variety of different shapes, including but not limited to circles, ellipses, ovals, squares, triangles, pentagons, hexagons, heptagons, octagons, etc. The period of time represented by the face boundary 103 of the system 100 can vary from embodiment to embodiment and from different hands 108 of the clock. For example, in a typical clock, an "hour hand" 110 will complete one rotation in 12 hours, a "minute hand" 112 will complete one rotation in 60 minutes, and a "second hand" 114 in 60 seconds. Different embodiments of the system 100 can involve different periods of time for different hands of the clock. Many embodiments of the system 100 will not involve a second hand 114.

In a preferred embodiment, the face boundary 103 is a curved face boundary 104, such as a circle. A curved face boundary 104 is a face boundary 103 that involves at least a partially curved shape, such as a circle, oval, or ellipse. Other shapes (particularly shapes with certain symmetrical attributes) can be used in alternative embodiments of the system 100.

D. Pivot Point

A pivot point 106 is a point on which the hands 108 pivot around. The pivot point 106 can also be referred to as a "rotation point" 106. The pivot point 106 will typically be positioned in the vertical and horizontal center of the face boundary 103. In some embodiments, the pivot point 106 will be positioned substantially in the vertical and horizontal center of the face boundary 103. In some embodiments, the pivot point 106 may be positioned elsewhere within the face boundary 103.

E. Hands

A hand 108 is a line segment that pivots on the pivot point 106 and reach outward from the pivot point 106 to the shape boundary 103. The movement and/or position of the hand 108 illustrates the passage of time and/or time of day. Examples of hands 108 include an hour hand 110, a minute hand 112, and a second hand 114. In some embodiments of the system 100, hands 108 can move in a linear manner while in other embodiments they can move in a step-wise fashion. Some embodiments of the system 100 can have no hands 108, other embodiments can have three hands 108. In some embodiments of the system 100, the individual user can customize the configuration of hands 108. In many embodiments of the system 100, the hands 108 will be straight green lines although different shapes and colors can be incorporated into alternative embodiments. In some embodiments of the system 100, the thickness of the hands 108 will be about equal to the thickness of the face boundary 103.

1. Hour Hand

An hour 110 is a line segment or hand 108 serving as an indicator of the hour. The hour hand 110 will typically complete a single rotation around the pivot point 106 every 12 hours, although alternative lengths of time can be associated with a single rotation of the hour hand 110.

2. Minute Hand

A minute hand 112 is line segment or hand 108 serving as an indicator of the minute. The minute hand 112 will typically complete a single rotation around the pivot point 106 every 60 minutes, although alternative lengths of time can be associated with a single rotation of the minute hand 112.

3. Second Hand

A second hand 114 is a line segment or hand 108 serving as an indicator of the second. The second hand 114 will typically complete a single rotation around the pivot point 106 every 60 seconds, although alternative lengths of time can be associated with a single rotation of the second hand 114. A second hand 114 is optional in many embodiments of the system 100.

F. Reference Points

A reference point 116 is a symbol displayed on a point on the boundary face 103 that helps the viewer identify and interpret the time of day. Reference points 116 can be a wide variety of different shapes, numbers, letters, symbols, graphics, etc. Reference points 116 can be fixed reference points 118 or moving reference points 120. In a typically embodiment of the system 100, there will be four fixed reference points 118 and two moving reference points 120. In some embodiments of the system 100, different types of reference points 116 are of the same shape and size (i.e. identical in shape and size), and are differentiated on the basis of color, whether the shape is hollow or not, etc. In a preferred embodiment, the diameter of the reference points 116 is about equal to or exceeds the thickness of the hands by a ratio of 5 to 1.

1. Fixed Reference Points

A fixed reference point 118 is a reference point 116 on the face boundary 103 that does not move. Fixed reference points 118 can also be referred to as "non-moving reference points" 118. A typical embodiment of the system 100 will involve four fixed reference points 118 at the 12 o'clock, 3 o'clock, 6 o'clock, and 9 o'clock positions. Fixed reference points 118 will in most embodiments be displayed differently than moving reference points 120 to aid users in interpreting the time information that is displayed by the system 100.

In many embodiments, the fixed reference points 118 are indicated by a solid red circles, although different shapes and colors can be used.

Fixed reference points 118 divide the face boundary 103 into sectors. Different sector sizes and shapes can be incorporated into the system 100.

2. Moving Reference Points

A moving reference point 120 is a reference point 116 on the face boundary that does move with the passage of time, typically a change in the hour of time. Moving reference points 120 can also be referred to as "non-fixed reference points" 120. A typical embodiment of the system 100 will include a current hour 122 and a next hour 124. In many embodiments of the system 100, moving reference points only point directly to a specific hour location on the arc 102 (i.e. not displayed between hour locations). Some embodiments may use a previous hour reference point in addition to or as a substitute for another moving reference point 120. In some embodiments, a moving reference point 120 will totally block a fixed reference point 118 when both occupy the same hour position.

a. Current Hour Reference Point

A current hour reference point 122 is a moving reference point 120 that indicates the current hour of time. The current hour reference point 122 can also be referred to as the "most recently passed hour reference point" 122. In many embodiments, the current hour reference point 122 is a solid white circle, although different shapes and colors can be used.

b. Next Hour Reference Point

A next hour reference point 124 is a moving reference point 120 that indicates the hour after the current hour. The next hour reference point 124 can also be referred to as the "upcoming hour reference point" 124. In many embodiments, the next hour reference point 124 is a white outline of a circle with a black or background color filling the circle to differentiate the next hour reference point 124 from the current hour reference point 122.

c. Previous Hour Reference Point

A previous hour reference point is a moving reference point 120 that trails the current hour reference point 122 rather than leading the current hour reference point 122 as the next hour reference point 124 does.

III. Additional Optional Elements

Figure 1B:
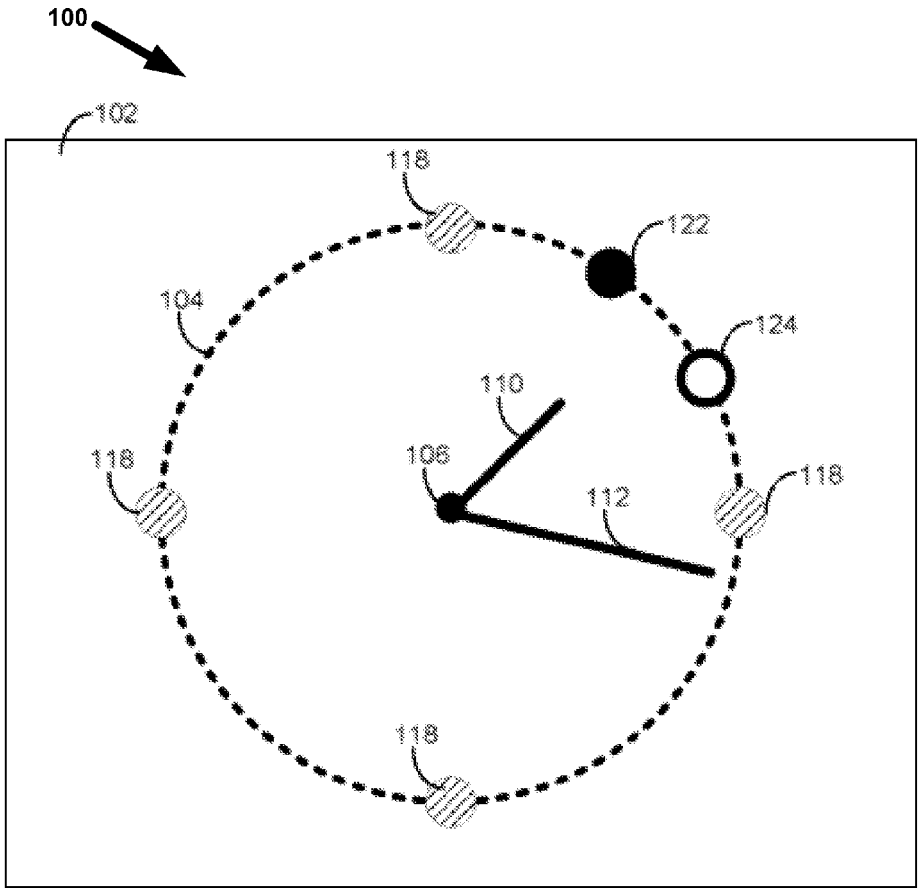
FIG. 1*b* is a diagram illustrating an example of a system that includes four fixed reference points, two movable reference points, a curved face boundary, an hour hand, and a minute hand.

FIG. 1*b* is a diagram illustrating an example of a system 100 that includes four fixed reference points 118, two movable reference points 120, a curved face boundary 104, an hour hand 110, and a minute hand 112. On this template of elements, additional elements can be added in various embodiments.

Figure 1C:
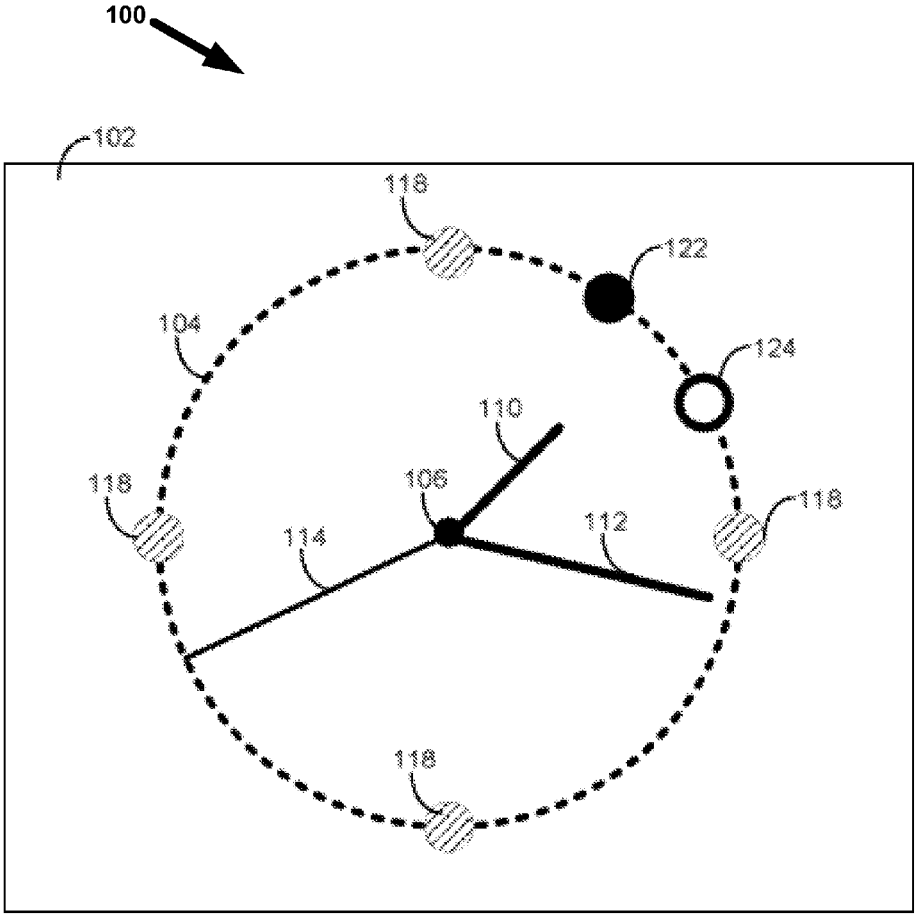
FIG. 1*c* is a diagram illustrating an example of a system similar to the system illustrated in FIG. 1*b*, with the addition of a second hand.

FIG. 1*c* is a diagram illustrating an example of a system 100 similar to the system illustrated in FIG. 1*b*, with the addition of a second hand 114.

A. Clock Numbers

Figure 1D:
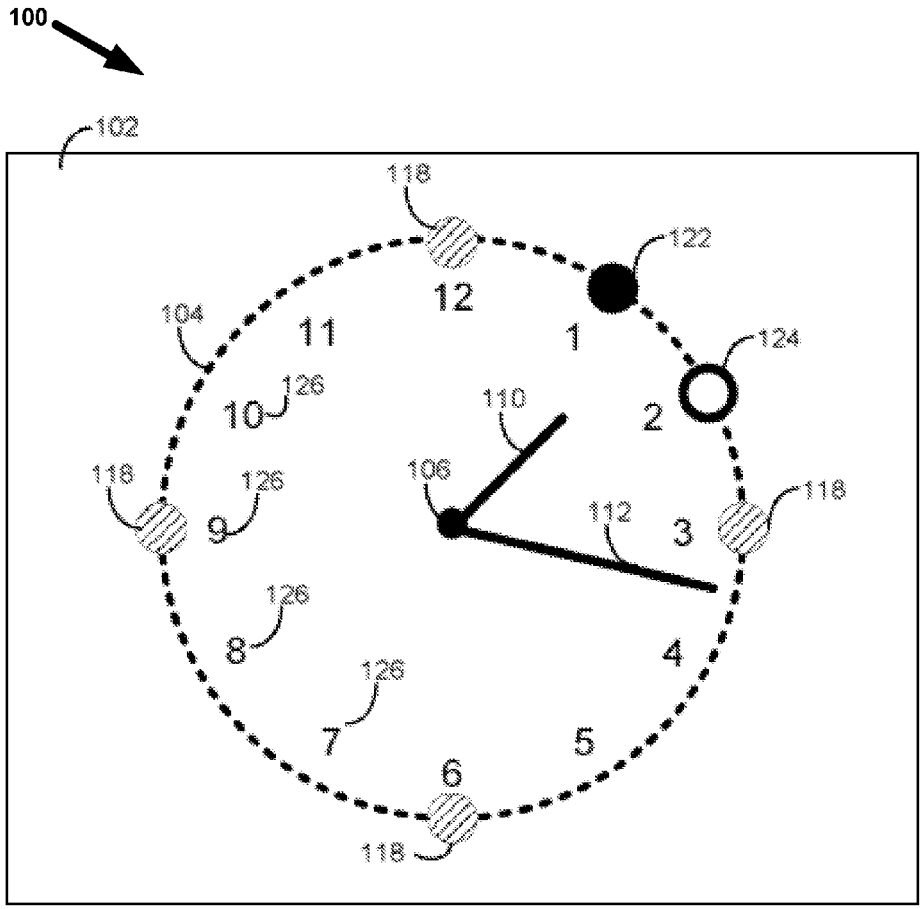
FIG. 1*d* is a diagram illustrating an example of a system similar to the system illustrated in FIG. 1*b*, with the addition of twelve conventional clock numbers.

FIG. 1*d* is a diagram illustrating an example of a system 100 similar to the system 100 illustrated in FIG. 1*b*, with the addition of twelve conventional clock numbers 126. A clock number 126 is a number representing an hour of the day. Typically clock numbers run from 1-12, although different alternative configurations are possible, including but not limited to 1-24. The system 100 need not include clock numbers 126. Clock numbers 126 can add unnecessary clutter to the display of the system 100, but some users may want that option for themselves or for others in their household or operating environment.

B. Time Display

Figure 1E:
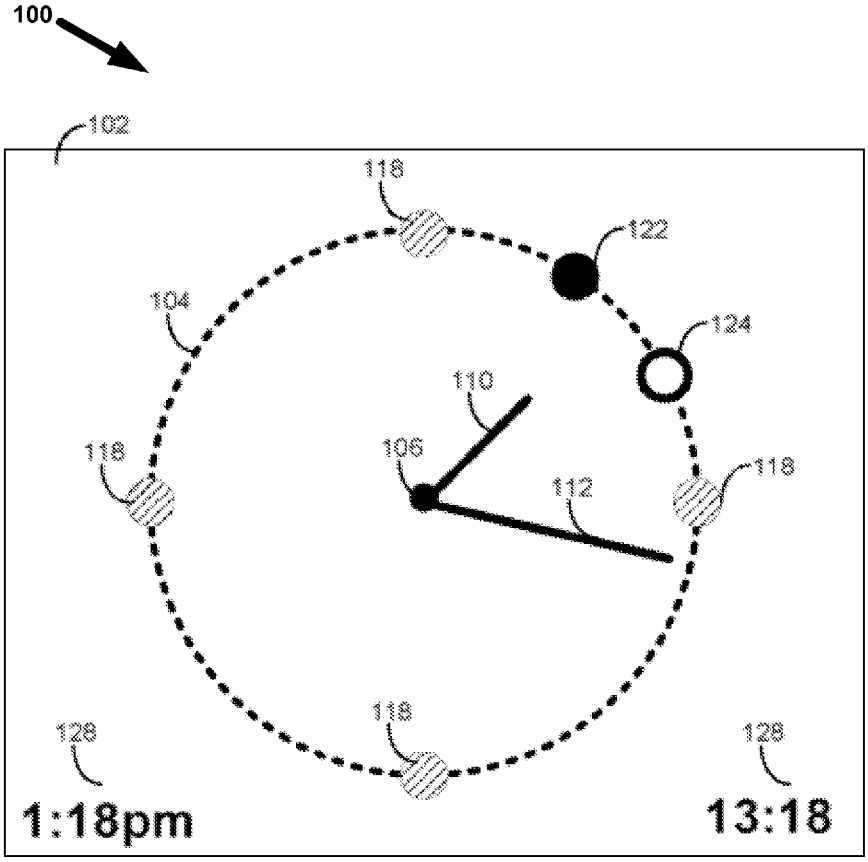
FIG. 1*e* is a diagram illustrating an example of a system similar to the system illustrated in FIG. 1*b*, with the addition of two time displays.
Figure 1F:
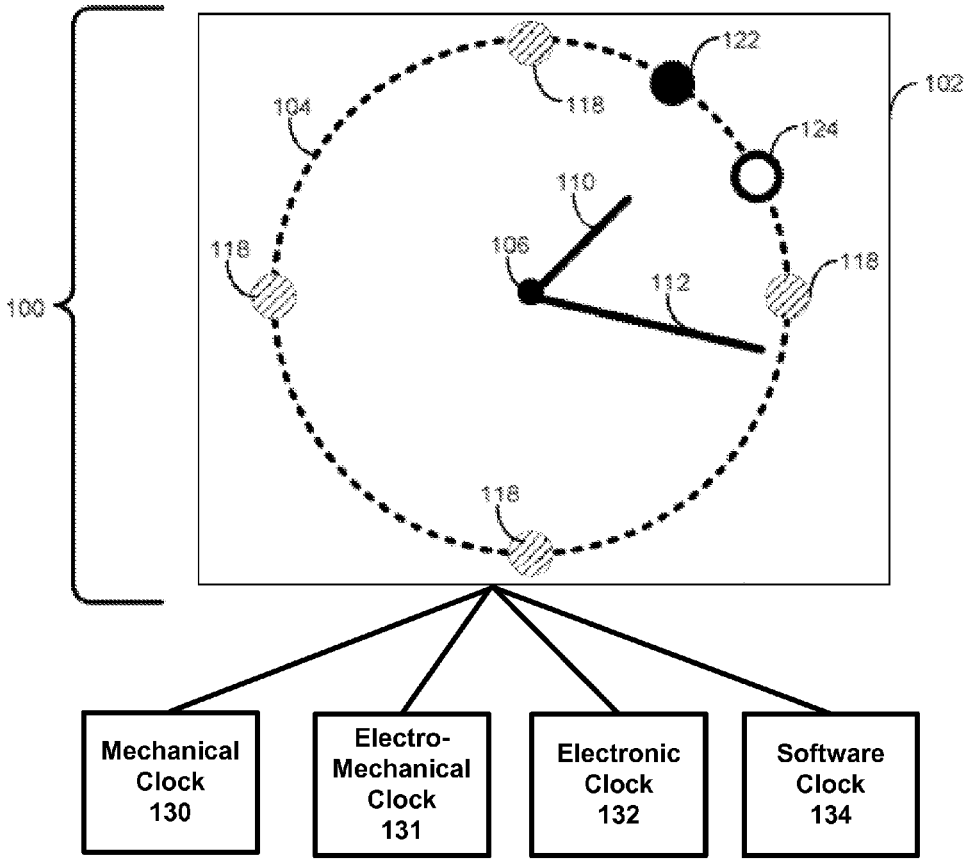
FIG. 1*f* is a block diagram illustrating an example of a system that can be embodied in a mechanical clock apparatus, an electro-mechanical clock apparatus, an electrical clock apparatus, and as software running in a computer.

FIG. 1*e* is a diagram illustrating an example of a system 100 similar to the system 100 illustrated in FIG. 1*b*, with the addition of two time displays 128. A time display 128 is a display in an "XX:YY" or "XX:YY:ZZ" format where XX represents the hour, YY represents the minute, and ZZ represents the seconds. Many embodiments of the system 100 will not include a digital time display 128.

IV. Operating Technologies

FIG. 1*f* is a block diagram illustrating an example of a system 100 that can be embodied in a mechanical clock apparatus 130, an electro-mechanical clock apparatus 131, an electrical clock apparatus 132, and as software 134 running on a computer.

A. Mechanical Clock

A mechanical clock 130 is a system 100 that operates using mechanical means such as a conventional mechanical analog clock.

B. Electro-Mechanical Clock

An electro-mechanical clock 131 is a system 100 that operates using both mechanical means and electrical means.

C. Electrical Clock

An electrical clock 132 is a system 100 that operates using electronic means such as a conventional electronic analog clock.

D. Software Clock

A software clock 134 is a system 100 that operates using electronic means such as a computer program running on a desktop computer, a laptop computer, a mobile computer, a tablet computer, a smart phone, a television, or other similar device.

V. Process Flow View

Figure 2:
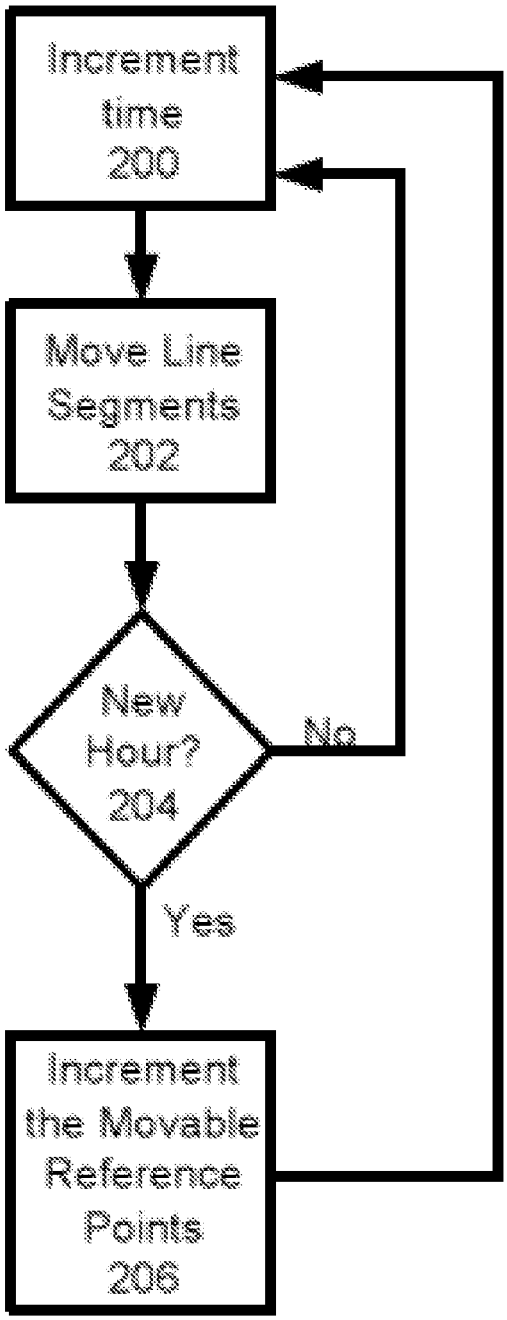
FIG. 2 is a flow chart diagram illustrating a process by which the movable reference points move along a face boundary.

FIG. 2 is a flow chart diagram illustrating an example of a process that can be implemented by the system 100.

At 200, time is incremented appropriately.

At 202, one or more line segments (i.e. hands 108) are moved in accordance with the passage of time passing at 200. In a preferred embodiment of the system 100, the hands 108 of the system 100 move in a linear/incremental fashion. In alternative embodiments, one or more hands of the system 100 can move in discrete step-wise fashion rather than a continuous fashion.

At 204, the system 100 checks to see if the hour of time was changed in the last incremental measurement of time. If the hour has not changed, the process returns to 200 where time is again incremented. If the hour has changed, the moveable reference points 120 are moved in accordance with the new hour.

In a preferred embodiment, there are two moveable reference points 120, a current hour reference point 122 that is located at the current hour position, and a next hour reference point 124 positioned at the hour coming after the current hour. In some embodiments of the system 100, there may be a prior hour reference point in addition to or as an alternative to the next hour reference point 120.

As discussed above, reference points 116 can be implemented in a wide variety of different formats (i.e. numbers such as the analog clock position equivalent, shapes, graphics) illustrated in different shapes and sizes.

VI. Examples of Reference Point Positions

Different embodiments of the system 100 can involve different types and numbers of component elements configured in different shapes and sizes. Different embodiments of the system 100 can provide users with the different capabilities to customize the display of the system 100, changing the colors, shapes, types, and other attributes. For example, most embodiments of the system 100 will include some hands 108 as well as reference points 116. However, the system 100 could be configured to allow users to change the number of hands 108 or eliminate them altogether if the user wants to focus solely on high-level hour information. FIGS. 3*a*-3*m* do not disclose any hands 106 or a pivot point 106 in order to highlight the functionality of the reference points 116. It is anticipated that most embodiments will include additional elements, but it is possible that some embodiments will not include additional elements or may be configurable to not always display such elements. The configuration and movement of reference points 116 displayed in FIGS. 3*a*-3*m* coincide with the process illustrated in FIG. 2. Alternative embodiments of the process may result in different reference point configurations in FIGS. 3*a*-3*m*.

A. Template of Underlying Fixed Reference Points

Figure 3A:
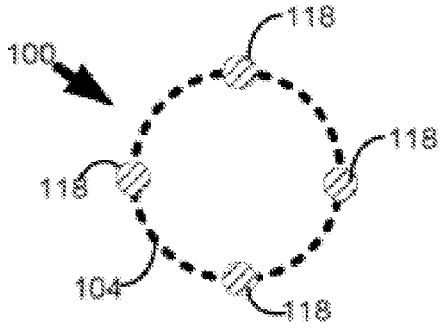
FIG. 3*a* is a diagram illustrating an example of a system that includes four fixed reference points.

FIG. 3*a* is a diagram illustrating an example of a system 100 that includes four fixed reference points 118. In most embodiments of the system 100, there will always be some movable reference points 116 displayed in addition to the fixed reference points 118. FIG. 3*a* represents a template configuration of fixed reference points 118 on which the moveable reference points 116 can navigate. Different embodiments of the system 100 can have different numbers of fixed reference points 100. Different embodiments of the system 100 can have fixed reference points 118 with different shapes, different types of characters, etc.

B. Times from 12:00:00-12:59:59

Figure 3B:
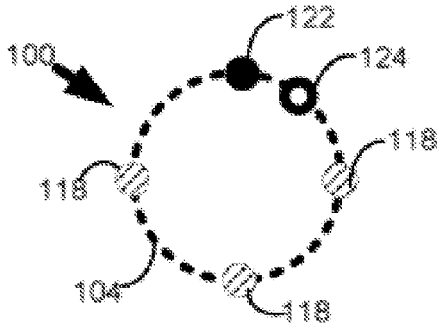
FIG. 3*b* is diagram illustrating the position of fixed reference points and movable reference points when the time of day is between 12:00:00 and 12:59:59.

FIG. 3*b* is diagram illustrating the position of fixed reference points 118 and movable reference points 120 when the time of day is between 12:00:00 and 12:59:59 (either p.m. or a.m.). The next hour reference point 124 is in a "1" position and the current hour reference point 122 is in a "12" position, blocking the fixed reference point 118 in that position.

C. Times from 01:00:00-01:59:59

Figure 3C:
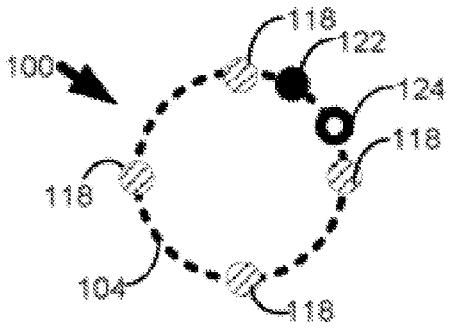
FIG. 3*c* is diagram illustrating the position of fixed reference points and movable reference points when the time of day is between 01:00:00 and 01:59:59.

FIG. 3*c* is diagram illustrating the position of fixed reference points 118 and movable reference points 120 when the time of day is between 01:00:00 and 01:59:59 (either p.m. or a.m.). The next hour reference point 124 is in a "2" position and the current hour reference point 122 is in a "1" position.

D. Times from 02:00:00-02:59:59

Figure 3D:
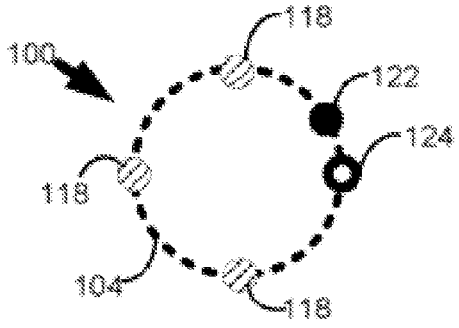
FIG. 3*d* is diagram illustrating the position of fixed reference points and movable reference points when the time of day is between 02:00:00 and 02:59:59.

FIG. 3*d* is diagram illustrating the position of fixed reference points 118 and movable reference points 120 when the time of day is between 02:00:00 and 02:59:59 (either p.m. or a.m.). The next hour reference point 124 is in a "3" position, blocking the fixed reference point 118 in that position. The current hour reference point 122 is in a "2" position.

E. Times from 03:00:00-03:59:59

Figure 3E:
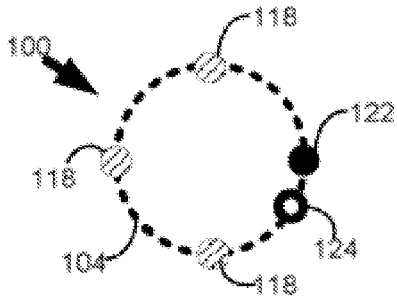
FIG. 3*e* is diagram illustrating the position of fixed reference points and movable reference points when the time of day is between 03:00:00 and 03:59:59.

FIG. 3*e* is diagram illustrating the position of fixed reference points 118 and movable reference points 120 when the time of day is between 03:00:00 and 03:59:59 (either p.m. or a.m.). The next hour reference point 124 is in a "4" position and the current hour reference point 122 is in a "3" position, blocking the fixed reference point 118 in that position.

F. Time from 04:00:00-04:59:59

Figure 3F:
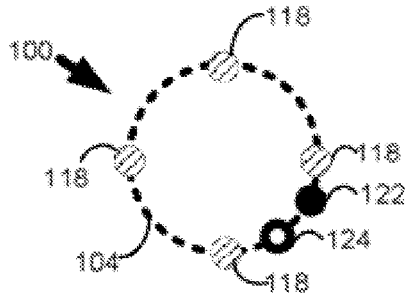
FIG. 3*f* is diagram illustrating the position of fixed reference points and movable reference points when the time of day is between 04:00:00 and 04:59:59.

FIG. 3*f* is diagram illustrating the position of fixed reference points 118 and movable reference points 120 when the time of day is between 04:00:00 and 04:59:59 (either p.m. or a.m.). The next hour reference point 124 is in a "5" position and the current hour reference point 122 is in a "4" position.

G. Time from 05:00:00-05:59:59

Figure 3G:
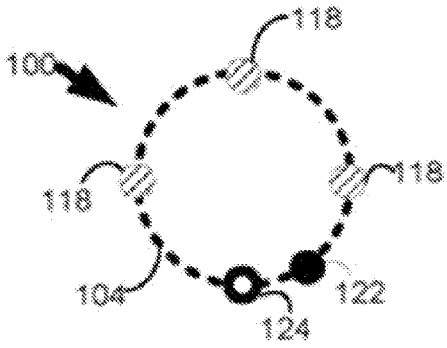
FIG. 3*g* is diagram illustrating the position of fixed reference points and movable reference points when the time of day is between 05:00:00 and 05:59:59.

FIG. 3*g* is diagram illustrating the position of fixed reference points 118 and movable reference points 120 when the time of day is between 05:00:00 and 05:59:59 (either p.m. or a.m.). The next hour reference point 124 is in a "6" position, blocking the fixed reference point 118 in that position. The current hour reference point 122 is in a "5" position.

H. Time from 06:00:00-06:59:59

Figure 3H:
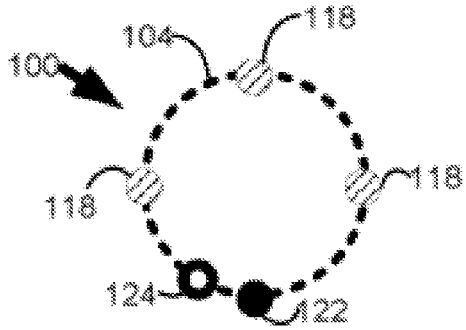
FIG. 3*h* is diagram illustrating the position of fixed reference points and movable reference points when the time of day is between 06:00:00 and 06:59:59.

FIG. 3*h* is diagram illustrating the position of fixed reference points 118 and movable reference points 120 when the time of day is between 06:00:00 and 06:59:59 (either p.m. or a.m.). The next hour reference point 124 is in a "7" position and the current hour reference point 122 is in a "6" position, blocking the fixed reference point 118 in that position.

I. Time from 07:00:00-07:59:59

Figure 3I:
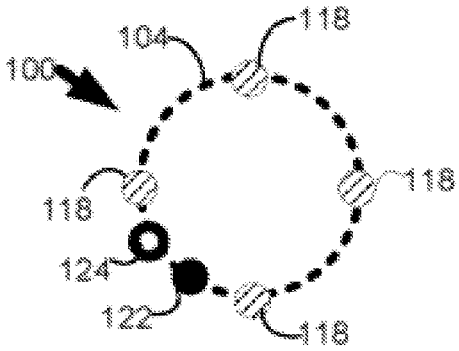
FIG. 3*i* is diagram illustrating the position of fixed reference points and movable reference points when the time of day is between 07:00:00 and 07:59:59.

FIG. 3*i* is diagram illustrating the position of fixed reference points 118 and movable reference points 120 when the time of day is between 07:00:00 and 07:59:59 (either p.m. or a.m.). The next hour reference point 124 is in a "8" position and the current hour reference point 122 is in a "7" position.

J. Time from 08:00:00-08:59:59

Figure 3J:
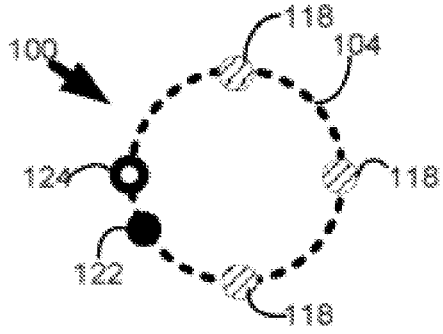
FIG. 3*j* is diagram illustrating the position of fixed reference points and movable reference points when the time of day is between 08:00:00 and 08:59:59.

FIG. 3*j* is diagram illustrating the position of fixed reference points 118 and movable reference points 120 when the time of day is between 08:00:00 and 08:59:59 (either p.m. or a.m.). The next hour reference point 124 is in a "9" position, blocking the fixed reference point 118 in that position. The current hour reference point 122 is in a "8" position.

K. Time from 09:00:00-09:59:59

Figure 3K:
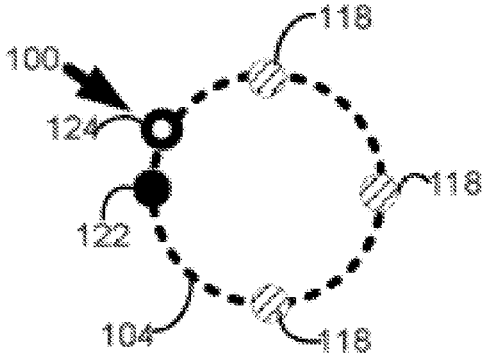
FIG. 3*k* is diagram illustrating the position of fixed reference points and movable reference points when the time of day is between 09:00:00 and 09:59:59.

FIG. 3*k* is diagram illustrating the position of fixed reference points 118 and movable reference points 120 when the time of day is between 09:00:00 and 09:59:59 (either p.m. or a.m.). The next hour reference point 124 is in a "10" position and the current hour reference point 122 is in a "9" position, blocking the fixed reference point 118 in that position.

L. Time from 10:00:00-10:59:59

Figure 3L:
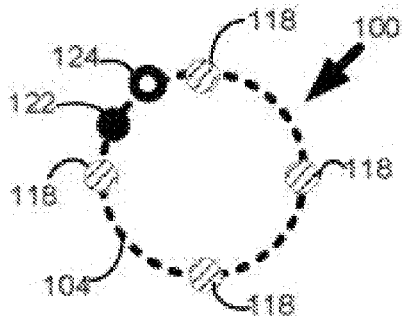
FIG. 3*l* is diagram illustrating the position of fixed reference points and movable reference points when the time of day is between 10:00:00 and 10:59:59.

FIG. 3*l* is diagram illustrating the position of fixed reference points 118 and movable reference points 120 when the time of day is between 10:00:00 and 10:59:59 (either a.m. or p.m.). The next hour reference point 124 is in a "11" position and the current hour reference point 122 is in a "10" position.

M. Time from 11:00:00-11:59:59

Figure 3M:
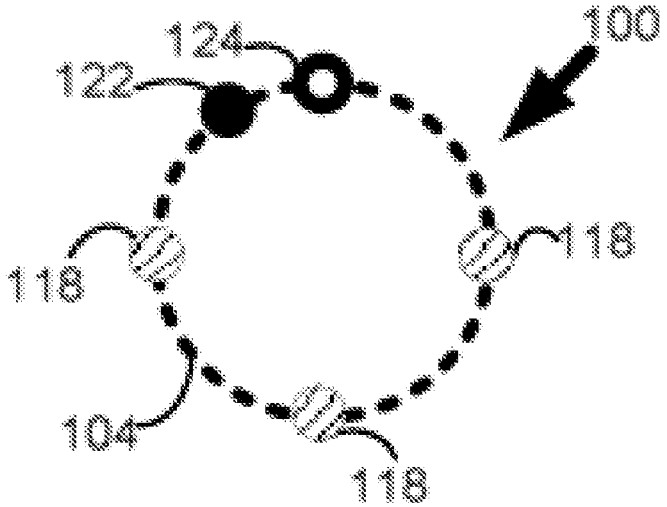
FIG. 3*m* is diagram illustrating the position of fixed reference points and movable reference points when the time of day is between 11:00:00 and 11:59:59.

FIG. 3*m* is diagram illustrating the position of fixed reference points 118 and movable reference points 120 when the time of day is between 11:00:00 and 11:59:59 (either p.m. or a.m.). The next hour reference point 124 is in a "12" position, blocking the fixed reference point 118 in that position. The current hour reference point 122 is in a "11" position.

VII. Index of Elements

Table 1 provides an index of element numbers, element names, and element descriptions.

| Element Number | Element Name | Element Description |
|---|---|---|
| 100 | System | A system, method, or apparatus (collectively a "system") for displaying a time of day. The system 100 can also be referred to as a "clock apparatus" 100 or simply the "apparatus" 100 or "clock" 100. The system 100 can be implemented in the form of a mechanical clock 130, an electronic clock 132, an electro-mechanical clock 131, or as a computer program 134 displayed on a screen or similar surface such as monitor, television set, or display screen for a smart phone or tablet computer. The system 100 typically includes a face boundary 103, one or more hands 108, and one or more reference points 116. |
| 102 | Background | Screen or surface behind the other elements of the system 100. Can also be referred to as the "display background" or "display surface". In a preferred embodiment, the background is solid black but a wide variety of different colors and/or graphically pattern configurations can be used. |
| 103 | Face Boundary | A boundary comprising a line segment or a collection of line segments. The face boundary 103 can be unbroken or broken, such as a configuration of dotted or dashed segments. A point at the center of the face boundary 103 will often serve as a pivot point 106 for one or more hands 108 of the system 100. Face boundaries 103 can be embodied in a wide variety of different shapes, including but not limited to circles, ellipses, ovals, squares, triangles, pentagons, hexagons, heptagons, octagons, etc. The period of time represented by the face boundary 103 of the system 100 can vary from embodiment to embodiment and from different hands 108 of the clock. For example, in a typical clock, an "hour hand" 110 will complete one rotation in 12 hours, a "minute hand" 112 will complete one rotation in 60 minutes, and a "second hand" 114 in 60 seconds. Different embodiments of the system 100 can involve different periods of time for different hands of the clock. Many embodiments of the system 100 will not involve a second hand 114. |
| 104 | Curved Face Boundary | A face boundary 103 that involves at least a partially curved shape, such as a circle, oval, or ellipse. |
| 106 | Pivot Point | Point on which the hands 108 pivot around. Can also be referred to as a "rotation point" 106. The pivot point 106 will typically be positioned in the vertical and horizontal center of the face boundary 103. In some embodiments, the pivot point 106 will be positioned substantially in the vertical and horizontal center of the face boundary 103. In some embodiments, the pivot point 106 may be positioned elsewhere within the face boundary 103. |

-continued

| Element Number | Element Name | Element Description |
|---|---|---|
| 108 | Hand | Line segments that pivot on the pivot point 106 and reach outward from the pivot point 106 to the shape boundary 103. The movement and/or position of the hand 108 illustrates the passage of time and/or time of day. Examples of hands 108 include an hour hand 110, a minute hand 112, and a second hand 114. In some embodiments of the system 100, hands 108 can move in a linear manner while in other embodiments they can move in a step-wise fashion. |
| 110 | Hour Hand | A line segment or hand 108 serving as an indicator of the hour. The hour hand 110 will typically complete a single rotation around the pivot point 106 every 12 hours, although alternative lengths of time can be associated with a single rotation of the hour hand 110. |
| 112 | Minute Hand | A line segment or hand 108 serving as an indicator of the minute. The minute hand 112 will typically complete a single rotation around the pivot point 106 every 60 minutes, although alternative lengths of time can be associated with a single rotation of the minute hand 112. |
| 114 | Second Hand | A line segment or hand 108 serving as an indicator of the second. The second hand 114 will typically complete a single rotation around the pivot point 106 every 60 seconds, although alternative lengths of time can be associated with a single rotation of the second hand 114. |
| 116 | Reference Points | Reference points are points on the boundary face 103 that help the viewer identify and interpret the positions of the various hands 108. Reference points 116 can be fixed reference points 118 or moving reference points 120. In a typically embodiment of the system 100, there will be four fixed reference points 118 and two moving reference points 120. |
| 118 | Fixed Reference Points | Reference points 116 on the face boundary 103 that do not move. Can also be referred to as "non-moving reference points". A typical embodiment of the system 100 will involve four fixed reference points 118 at the 12 o'clock, 3 o'clock, 6 o'clock, and 9 o'clock positions. |
| 120 | Reference Points | Moving Reference points on the face boundary 103 that move with the passage of time. Can also be referred to as "non-fixed reference points". A typical embodiment of the system 100 will include a current hour 122 and a next hour 124. In many embodiments of the system 100, moving reference points only point directly to a specific hour location on the arc 102 (i.e. not displayed between hour locations). |
| 122 | Current Hour Reference Point | A moving reference point 120 that indicates the current hour of time. Can also be referred to as the "most recently passed hour reference point" 122. |
| 124 | Next Hour Reference Point | A moving reference point 120 that indicates the hour after the current hour. Can also be referred to as the "upcoming hour reference point" 124. |
| 126 | Clock Numbers | A number representing an hour of the day. Typically clock numbers run from 1-12, although different alternative configurations are possible. The system 100 need not include clock numbers 126. |
| 128 | Time Display | A time display in an "XX:YY" or "XX:YY:ZZ" format where XX represents the hour, YY represents the minute, and ZZ represents the seconds. Many embodiments of the system 100 will not include a digital time display. |
| 130 | Mechanical Clock | A clock embodying the system 100 that operates using mechanical means such as a conventional mechanical analog clock. |
| 131 | Electro-Mechanical Clock | A clock embodying the system 100 that operates using both mechanical means and electrical means. |
| 132 | Electronic Clock | A clock embodying the system 100 that operates using electronic means such as a conventional electronic analog clock. |
| 134 | Software Clock | A clock embodying the system 100 that operates using electronic means such as a computer program running on a desktop computer, a laptop computer, a mobile |

-continued

| Element Number | Element Name | Element Description |
|---|---|---|
| | | computer, a tablet computer, a smart phone, a television, or other similar device. |

VIII. Alternative Embodiments

The system 100 can be implemented in wide variety of different structural, process, and system configurations. In accordance with the provisions of the patent statutes, the principles and modes of operation of this invention have been explained and illustrated in preferred embodiments. However, it must be understood that this invention may be practiced otherwise than is specifically explained and illustrated without departing from its spirit or scope.

For example different embodiments can involve different numbers and types of component elements. The system 100 can utilize mechanical, electro-mechanical, electrical, or software/computer, means to implement the functionality of the system 100. Some embodiments of the system 100 can allow users to customize different aspects of the functionality of the system 100. The system 100 can utilize a wide variety of different patterns and colors in the background 102. A wide variety of different shapes (symmetrical and otherwise, curved and otherwise) can be incorporated into the face boundary 103. Pivot points 106 can be located and displayed in a wide variety of different ways in the face boundary 103. Hands 108 can be displayed in a variety of different colors, shapes, and sizes. Different embodiments of the system 100 can include different combinations and configurations of hands 108. Reference points 116 can be embodied in different graphics, letter, numbers, etc. that are of varying sizes, colors, and shapes.

The invention claimed is:

1. An system for displaying the time of day, comprising:
- a face boundary;
- a pivot point within said face boundary, wherein said pivot point is positioned at least substantially at the center of said face boundary;
- a plurality of reference points positioned on said face boundary, said plurality of reference points including a plurality of non-moving reference points and a plurality of moving reference points; and
- a plurality of hands extending outward from said pivot point, wherein said plurality of hands include a fixed end on said pivot point and a moveable end that rotates around said pivot point, said plurality of hands including a minute hand and an hour hand;
- wherein said plurality of moving reference points move along said boundary surface in one hour increments with the passage of each hour.

2. The system of claim 1, wherein said plurality of moving reference points comprise a first moving reference point that displays the most recently passed hour increment and a second moving reference point that displays the next upcoming incremental hour.

3. The system of claim 1, wherein all said reference points share an identical shape and an identical size.

4. The system of claim 3, wherein said moving reference points provide for completely blocking the display of said non-moving reference points when said moving reference points are positioned over the same space as said non-moving reference points on said face boundary.

5. The system of claim 1, further comprising a solid black background, wherein said non-moving reference points are red circles, wherein said hands are straight green line segments, wherein said minute hand intersects with said face boundary, and wherein said hour hand does not extend outwardly as far as said face boundary.

6. The system of claim 5, wherein said first moving reference point is a white circle and wherein said second moving reference point is a black circle with a white outline.

7. The system of claim 1, wherein said plurality of non-moving reference points include:
- a first reference point positioned on a top-most position on said face boundary;
- a second reference point positioned on a right-most position on said face boundary;
- a third reference point positioned on a bottom-most position on said face boundary; and
- a fourth reference point positioned on a left-most position on said face boundary.

8. The system of claim 1, wherein no number is displayed on said system.

9. The system of claim 1, wherein a numerical time value is displayed outside of said face boundary.

10. The system of claim 1, wherein said face boundary is a broken circle.

11. The system of claim 1, wherein the diameter of said reference points exceeds the thickness of said line segments by at least a ratio of 5 to 1.

12. The system of claim 1, wherein plurality of hands and said face boundary share a substantially identical thickness.

13. An system for displaying the time of day, comprising:
- a face boundary;
- a plurality of non-moving reference points that are positioned on said face boundary, said plurality of reference points including:
  - a first reference point positioned on a top-most position on said face boundary;
  - a second reference point positioned on a right-most position on said face boundary;
  - a third reference point positioned on a bottom-most position on said face boundary; and
  - a fourth reference point positioned on a left-most position on face boundary;
- a pivot point within said face boundary, wherein said pivot point is positioned substantially at the center of said face boundary;
- a plurality of hands extending outward from said pivot point and reaching outward towards said face boundary, wherein said plurality of hands provide for rotating around said pivot point, said plurality of line segments including:
  - an hour hand to representing the hour; and
  - a minute hand to represent the minute;
  - wherein said minute hand is substantially longer than said hour hand;
- a plurality of moving reference points that provide for moving around said face boundary with the passage of time, said plurality of moving reference points including a first reference point that represents the most recently passed hour and a second reference point that represents the next upcoming hour.

14. The system of claim 13, wherein said moving reference points and said non-moving reference points are circles, and wherein said face boundary is a curved face boundary.

15. The system of claim 13, wherein said non-moving reference points provide for being totally hidden from view when said moving reference points occupy the same incremental hour-based location.

16. The system of claim 13, wherein said non-moving reference points are red circles, wherein said first moving reference point is a white circle and wherein said second moving reference point is a hollow circle.

17. The system of claim 13, further comprising a third line segment representing a second hand.

18. A method for displaying the time of day, comprising:

rotating a minute hand in a clock-wise direction at a substantially constant speed and with substantially continuous motion such that a complete rotation of the minute hand occurs with the passage of a sixty minutes period of time;

rotating an hour hand in a clock-wise direction at a substantially constant speed and with substantially continuous motion such that a complete rotation of the hour hand occurs with the passage of a twelve hour period of time;

moving a current hour indicator around a face boundary with the passage of each hour in a discrete step-wise fashion; and incrementing a next hour indicator in a discrete step-wise fashion around the face boundary each time the current hour indicator is incremented.

19. The method of claim 18, further comprising displaying non-moving reference points at the 12 o'clock, 3 o'clock, 6 o'clock, and 9 o'clock hourly increments.

20. The method of claim 19, displaying the current hour indicator and next hour indicator over the non-moving reference points at 12 o'clock, 3 o'clock, 6 o'clock, and 9 o'clock reference points.

* * * * *